United States Patent [19]

Drapier et al.

[11] Patent Number: 5,057,237

[45] **Date of Patent: * Oct. 15, 1991**

[54] THIXOTROPIC LIQUID AUTOMATIC DISHWASHER DETERGENT COMPOSITION WITH IMPROVED PHYSICAL STABILITY

[75] Inventors: Julien Drapier, Seraing; Chantal Gallant, Cheratte; France Wouters, Herstal; Leo Laitem, Orp-Jauche, all of Belgium

[73] Assignee: Colgate Palmolive Co., Piscataway, N.J.

[ * ] Notice: The portion of the term of this patent subsequent to Jun. 21, 2005 has been disclaimed.

[21] Appl. No.: 462,891

[22] Filed: Jan. 3, 1990

Related U.S. Application Data

[63] Continuation of Ser. No. 131,278, Dec. 10, 1987, abandoned, which is a continuation of Ser. No. 744,754, Jun. 14, 1985, abandoned.

[51] Int. Cl.[5] ..... C11D 17/00; C11D 3/60; C11D 10/04

[52] U.S. Cl. ..... 252/97; 252/94; 252/95; 252/96; 252/99; 252/109; 252/156; 252/174.14; 252/DIG. 14

[58] Field of Search ..... 252/99, 89.1, 174.25, 252/90, 94, 95, 96, 135, 140, 155, 156, DIG. 14, 109, 97, 174.14

[56] References Cited

U.S. PATENT DOCUMENTS

| | | | |
|---|---|---|---|
| 4,071,377 | 1/1978 | Schwuger et al. | 252/99 |
| 4,226,736 | 10/1980 | Bush et al. | 252/135 |
| 4,240,919 | 12/1980 | Chapman | 252/95 |
| 4,333,771 | 6/1982 | Altenschopfer et al. | 252/179 |
| 4,661,280 | 4/1987 | Ouhadi et al. | 252/99 |

FOREIGN PATENT DOCUMENTS

| | | |
|---|---|---|
| 2116199 | 9/1983 | United Kingdom . |
| 2140450 | 11/1984 | United Kingdom . |

*Primary Examiner*—Paul Lieberman
*Assistant Examiner*—Linda D. Skaling
*Attorney, Agent, or Firm*—Richard Nanfeldt; Murray M. Grill; Robert C. Sullivan

[57] ABSTRACT

The physical stability of liquid gel-like automatic dishwasher detergent compositions based on montmorillonite, attapulgite, hectorite or other inorganic colloid-forming clay or other thixotropic thickener is greatly improved by incorporating in the composition small amounts, such as 0.1 or 0.2 weight percent, of aluminum or zinc stearate or other polyvalent metal salt of long chain fatty acid. The aqueous compositions containing inorganic builder salts and other functional inorganic salts, chlorine bleach, bleach-stable detergent, thixotropic thickener and polyvalent metal salt of a fatty acid as a physical stabilizer remain stable against phase separation for periods in excess of six weeks under a wide range of temperatures. The thixotropic properties can be retained or improved using smaller levels of the clay thixotropic thickener than in the absence of the physical stabilizer.

16 Claims, No Drawings

THIXOTROPIC LIQUID AUTOMATIC DISHWASHER DETERGENT COMPOSITION WITH IMPROVED PHYSICAL STABILITY

This application is a continuation of application Ser. No. 07/131,278, filed Dec. 10, 1987, now abandoned, which is a continuation of application Ser. No. 744,754, filed June 14, 1985 now abandoned.

The present invention relates to automatic dishwashing detergent compositions having thixotropic properties, improved chemical and physical stability, and which are readily dispersible in the washing medium to provide effective cleaning of dishware, glassware, china and the like.

Commercially available household-machine dishwasher detergents provided in powder form have several disadvantages, e.g. non-uniform composition; costly operations necessary in their manufacture; tendency to cake in storage at high humidities, resulting in the formation of lumps which are difficult to disperse; dustiness, a source of particular irritation to users who suffer allergies; and tendency to cake in the dishwasher machine dispenser. Liquid forms of such compositions, moreover, generally cannot be used in automatic dishwashers due to high foam levels, unacceptably low viscosities and exceedingly high alkalinity.

Recent research and development activity has focussed on the gel or "thixotropic" form of such compositions, e.g. scouring cleansers and automatic-dishwasher products characterized as thixotropic pastes. Dishwasher products so provided are primarily objectionable in that they are insufficiently viscous to remain "anchored" in the dispenser cup of the dishwasher, and moreover yield spotty residues on dishware, glassware, china and the like. Ideally, thixotropic cleansing compositions should be highly viscous in a quiescent state, Bingham plastic in nature, and have relatively high yield values. When subjected to shear stresses, however, such as being shaken in a container or squeezed through an orifice, they should quickly fluidize and, upon cessation of the applied shear stress, quickly revert to the high viscosity/Bingham plastic state. Stability is likewise of primary importance, i.e. there should be no significant evidence of phase separation or leaking after long standing.

The provision of automatic-dishwasher compositions in gel form having the aforedescribed properties has thus far proven problematical, particularly as regards compositions for use in home dishwasher machines. For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for fine china glaze and pattern; (3) sodium carbonate, generally considered to be optional, to enhance alkalinity; (4) a chlorine-releasing agent to aid in the elimination of soil specks which lead to water spotting; and (5) defoamer/surfactant to reduce foam, thereby enhancing machine efficiency and supplying requisite detergency. See, for example, SDA Detergents in Depth, "Formulations Aspects of Machine Dishwashing," Thomas Oberle (1974). Cleansers approximating to the afore-described compositions are mostly liquids or powders. Combining such ingredients in a gel form effective for home-machine use has proved difficult. Generally, such compositions omit hypochlorite bleach, since it tends to react with other chemically active ingredients, particularly surfactant, thereby degrading the suspending or thixotropic agent and impairing its effectiveness. Thus, U.S. Pat. No. 4,115,308 discloses thixotropic automatic dishwasher pastes containing a suspending agent, e.g. CMC, synthetic clays or the like; inorganic salts including silicates, phosphates and polyphosphates; a small amount of surfactant and a suds depressor. Bleach is not disclosed. U.S. Pat. No. 4,147,650 is somewhat similar, optionally including Cl-(hypochlorite) bleach but no organic surfactant or foam depressant. The product is described, moreover, as a detergent slurry with no apparent thixotropic properties.

U.S. Pat. No. 3,985,668 describes abrasive scouring cleaners of gel-like consistency containing (1) suspending agent, preferably the Smectite and attapulgite types of clay; (2) abrasive, e.g. silica sand or perlite; and (3) filler comprising light density powdered polymers, expanded perlite and the like, which has a bouyancy and thus stabilizing effect on the composition in addition to serving as a bulking agent, thereby replacing water otherwise available for undesired supernatant layer formation due to leaking and phase destabilization. The foregoing are the essential ingredients. Optional ingredients include hypochlorite bleach, bleach stable surfactant and buffer, e.g. silicates, carbonates, and monophosphates. Builders, such as NaTPP, can be included as further optional ingredients to supply or supplement building function not provided by the buffer, the amount of such builder not exceeding 5% of the total composition, according to the patent. Maintenance of the desired (greater than) pH 10 levels is achieved by the buffer/builder components. High pH is said to minimize decomposition of chlorine bleach and undesired interaction between surfactant and bleach. When present, NaTPP is limited to 5%, as stated. Foam killer is not disclosed.

In U.K. Patent Application GB 2,116,199A and GB 2,140,450A, both of which are assigned to Colgate-Palmolive, liquid ADD compositions are disclosed which have properties desirably characterizing thixotropic, gel-type structure and which include each of the various ingredients necessary for effective detergency with an automatic dishwasher. The normally gel-like aqueous automatic dishwasher detergent composition having thixotropic properties includes the following ingredients, on a weight basis:

(a) 5 to 3% alkali metal tripolyphosphate;
(b) 2.5 to 20% sodium silicate;
(c) 0 to 9% alkali metal carbonate;
(d) 0.1 to 5% chlorine bleach stable, water dispersible organic detergent active material;
(e) 0 to 5% chlorine bleach stable foam depressant;
(f) chlorine bleach compound in an amount to provide about 0.2 to 4% of available chlorine; and
(g) thixotropic thickener in an amount sufficient to provide the composition with thixotropy index of about 2.5 to 10.

ADD compositions so formulated are low-foaming; are readily soluble in the washing medium and most effective at pH values best conducive to improved cleaning performance, viz, pH 10.5–13.5. The compositions are normally of gel consistency, i.e. a highly viscous, opaque jelly-like material having Bingham plastic character and thus relatively high yield values. Accordingly, a definite shear force is necessary to initiate or increase flow, such as would obtain within the agitated dispenser cup of an energized automatic dishwasher. Under such conditions, the composition is quickly fluidized and easily dispersed. When the shear force is discontinued, the fluid composition quickly reverts to a high viscosity, Bingham plastic state closely approximateing its prior consistency.

While these previously disclosed liquid ADD formulations are not subject or subject to a lesser degree to one or more of the above described deficiencies, it has been found that in actual practice, still further improvements in physical stability are required to increase the shelf-like of the product and thereby enhance consumer acceptance.

Accordingly, it is an object of the invention to provide liquid ADD compositions having thixotropic properties with improved physical stability and rheological properties.

It is also an object of the invention to provide thixotropic liquid ADD compositions having reduced levels of thixotropic thickener without adversely effecting the generally high viscosities at low shear reates and lower viscosities at high shear rates which are characteristic of the desired thixotropic properties.

These and other objects of the invention which will become more readily understood from the following detailed description of the invention and preferred embodiments thereof are achieved by incorporating in a normally gel-like aqueous automatic dishwasher detergent composition an amount of a polyvalent metal salt of a long chain fatty acid which is effective to inhibit settling of the suspended particles, such as thixotropic agent.

Accordingly, in one broad aspect, the present invention provides a normally gel-like aqueous automatic dishwasher detergent composition having thixotropic properties which include, on a weight basis:

(a) 5 to 35% alkali metal tripolyphosphate;
(b) 2.5 to 20% sodium silicate;
(c) 0 to 9% alkali metal carbonate;
(d) 0.1 to 5% chlorine bleach stable, water dispersible organic detergent active material;
(e) 0 to 5% chlorine bleach stable foam depressant;
(f) chlorine bleach compound in an amount to provide about 0.2 to 4% of available chlorine;
(g) thixotropic thickener in an amount sufficient to provide the composition with a thixotropy index of about 2.0 to 10;
(h) 0 to 3% sodium hydroxide;
(i) a polyvalent metal salt of a long chain fatty acid in an amount effective to increase the physical stability of the composition; and
(j) balance water.

In another aspect the invention provides a method for cleaning dishware in an automatic dishwashing machine with an aqueous wash/bath containing an effective amount of the liquid automatic dishwasher deterent (LADD) composition as described above. According to this aspect of the invention, the LADD composition can be readily poured into the dispensing cup of the automatic dishwashing machine and will, within just a few seconds, promptly thicken to its normal gel-like state to remain securely within the dispensing cup until shear forces are again applied thereto, such as by the water spray from the dishwashing machine.

Generally, ADD effectiveness is directly related to (a) available chlorine levels; (b) alkalinity; (c) solubility in washing medium; and (d) foam inhibition. It is preferred herein that the pH of the ADD composition be at least about 9.5, more preferably from about 10.5 to 13.5 and most preferably at least about 11.5. At relatively lower pH values, the ADD product is too viscous, i.e. solid-like, and thus not readily fluidized under the shear-force levels created within the dispenser cup under normal machine operating conditions. In essence, the composition loses much, if not all, of its thixotropic character. Addition of NaOH is thus often needed to increase the pH to within the above ranges, and to increase flowability properties. The presence of carbonate is also often needed herein, since it acts as a buffer helping to maintain the desired pH level. Excess cabonate is to be avoided, however, since it may cause the formation of needle-like crystals of carbonate, thereby impairing the stability, thixotropy and/or detergency of the ADD product. Caustic soda (NaOH) serves the further function of neutralizing the phosphoric or phosphonic acid ester foam depressant when present. About 0.5 to 3 wt % of NaOH and about 2 to 9 wt % of sodium carbonate in the composition are preferred. About 0.5 to 3 wt % of NaOH and about 2 to 9 wt % of sodium carbonate in the composition are typical although it should be noted that sufficient alkalinity may be provided by the NaTPP and sodium silicate.

The NaTPP employed in the composition in a range of about 8 to 35 wt %, preferably about 20 to 30 wt %, should preferably be free of heavy metal which tends to decompose or inactivate the preferred sodium hypochlorite and other chlorine bleach compounds. The NaTPP may have an average degree of hydration of less than about 1 or more than about 5 e.g. 0 to 2.7% by weight or at least 16.5% of water, including the stable hexahydrate with a degree of hydration of 6 corresponding to about 18% by weight of water or more. Actually, humidification to an average of about 0.3 to 1% water is highly effective, serving it is thought to form seeds of the stable hexahydrate which expedites hydration and solubilization of the remaining NaTPP particles. On average, the NaTPP contains about 5 ; to 15% by weight water, corresponding to an average degree of hydration of about 1 to 5. If only the hexahydrate is used, the detergent product is liquid and has little if any thixotropic character. If only the anhydrous NaTPP is used, the product is too thick and therefore unsuitable. Effective compositions are obtained, for example, when using a 0.5:1 to 2:1 weight ratio of anhydrous to hexahydrated NaTPP, values of about 1:1 being particularly preferred.

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somwhat dependent on the hardness of the wash water in the machine whereby suitable adjustment of the proportions of NaTPP which has a water softening effect may aid in providing the desired degree of foam inhibition. However, it is generally preferred to include a chlorine bleach stable foam depressant or inhibitor. Particularly effective are the alkyl phosphonic acid esters of the formula

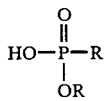

available for example from BASF--Wyandotte (PCUK-PAE), and especially the alkyl acid phosphate esters of the formula

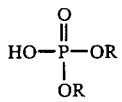

available for example from Hooker (SAP) and Knapsack (LPKn-158), in which one or both R groups in each type of ester may represent independently a $C_{12-20}$ alkyl group. Mixtures of the two types, or any other chlorine bleach stable types, or mixtures of mono- and di-esters of the same type, may be employed. Especially preferred is a mixture of mono- and di-$C_{16-18}$ alkyl acid phosphate esters such as monostearyl/distearyl acid phosphates 1.2/1 (Knapsack). When employed, proportions of 0.1 to 5 wt %, preferably about 0.1 to 0.5 wt %, of foam depressant in the composition is typical, the weight ratio of detergent active component (d) to foam depressant (e) generally ranging from about 10:1 to 1:1 and preferably about 4:1 to 1:1. Other defoamers which may be used include for example the known silicones.

Although any chlorine bleach compound may be employed in the compositions of this invention, such as dichloroisocyanurate, dichloro-dimethyl hydantoin, or chlorinated TSP, alkali metal, e.g. postassium, lithium, magnesium and especially sodium, hypochlorite is preferred. The composition should contain sufficient chlorine bleach compound to provide about 0.2 to 4.0% by weight of available chlorine, as determined for example by acidification of 100 parts of the composition with excess hydrochloric acid. A solution containing about 0.2 to 4.0% by weight of sodium hypochlorite contains or provides roughly the same percentage of available chlorine. About 0.8 to 1.6% by weight of available chlorine is especially preferred. For example, sodium hypochlorite (NaOCl) solution of 11 to 13% available chlorine in amounts of about 3 to 20%, preferably about 7 to 12%, can be advantageously used.

The sodium silicate, which provides alkalinity and protection of hard surfaces such as fine china glaze and pattern, is employed in an amount ranging from about 2.5 to 20 wt %, preferably about 5 to 15 wt %, in the composition. The sodium silicate is generally added in the form of an aqueous solution, preferably having an $Na_2O:SiO_2$ ratio of about 1:2.2 to 1:2.8. At this point, it should be mentioned that most of the other components of this composition, especially NaOH, sodium hypochlorite, foam depressant and thixotropic thickener, are also often added in the form of a preliminary prepared aqueous dispersion or solution.

Detergent active material useful herein must be stable in the presence of chlorine bleach, especially hypochlorite bleach, and preferably comprise those of the organic anionic, amine oxide, phosphine oxide, sulphoxide or betaine water dispersible surfactant types, the first mentioned anionics being most preferred. They are used in amounts ranging from about 0.1 to 5% preferably about 0.5 to 2.0%, more preferably about 0.3 to 0.8%. Particularly preferred surfactants herein are the linear or branched alkali metal mono- and/or di-($C_{8-14}$) alkyl diphenyl oxide mono and/or disulphates, commercially available for example as DOWFAX (Registered Trade Mark) 3B-2 and DOWFAX 2A-1. In general, the paraffin sulphonates tend to impair, if not destroy thixotropy, having been found to unduly increase viscosity causing severe shearing force problems. In addition, the surfactant should be compatible with the other ingredients of the composition. Other suitable surfactants include the primary alkylsulphonates, alkylsulphonates, alkylarylsulphonates and sec.-alkylsulphates. Examples are sodium $C_{10}$-$C_{18}$ alkylsulphates such as sodium dodecylsulphate and sodium tallow alcoholsulphate; sodium $C_{10}$-$C_{18}$ alkanesulphonates such as sodium hexadecyl-l-sulphonate and sodium $C_{12}$-$C_{18}$ alkylbenzenesulphonates such as sodcium dodecylbenzensulphonates. The corresponding potassium salts may also be employed.

As other suitable surfactants or detergents, the amine oxide surfactants are typically of the structure $R_2R^1NO$, in which each R represent a lower alkyl group, for instance methyl, and $R^1$ represents a long chain alkyl group having from 8 to 22 carbon atoms, for instance a lauryl, myristyl, palmityl or cetyl group. Instead of an amine oxide, a corresponding surfactant phosphine oxide $R_2R^1PO$ or sulphozide $RR^1SO$ can be employed. Betaine surfactants are typically of the structure $R_2R^1N{\leftarrow}R''COO^{13}$, in which each R represents a lower alkylene group having from 1 to 5 carbon atoms. Specific examples of these surfactants are lauryldimethylamine oxide, myristyldimethylamine oxide, the corresponding phosphine oxides and sulphoxides, and the corresponding betaines including dodecyldimethylammonium acetate, tetradecyldiethylammonium pentanoate, hexadecyldimethylammonium hexanoate and the like. For biodegradability, the alkyl groups in these surfactants should be linear, and such compounds are preferred.

Surfactants of the foregoing type, all well known in the art, are described, for example, in U.S. Pat. Nos. 3,985,668 and 4,271,030.

Thixotropic thickeners, i.e. thickeners or suspending agents which provide an aqueous medium with thixotropic properties, are known in the art and may be organic or inorganic water soluble, water dispersible or colloid-forming, and monomeric or polymeric, and should of course be stable in these compositions, e.g. stable to high alkalinity and chlorine bleach compounds, such as sodium hypochlorite. Those especially preferred generally comprise the inorganic, colloid-forming clays of smectite and/or attapulgite types. These materials were generally used in amounts of about 1.5 to 10, preferably 2 to 5 wt %, to confer the desired thixotropic properties and Bingham plastic character in the assignee's prior disclosed ADD formulations of the aforementioned GB 2,116,199A and GB 2,140,450A. It is one of the advantages of the ADD formulations of the present invention that the desired thixotropic properties and Bingbam plastic character can be obtained in the presence of the polyvalent metal salt fatty acid stabilizers with lesser amounts of the thixotropic thickeners. For example, amounts of the inorganic colloid-forming clays of the smectite and/or attapulgite types in the range of from about 0.1 to 3%, preferably 0.2 to 2.5%, especially 0.5 to 2.2%, are generally sufficient to achieve the desired thixotropic properties and Bingham plastic character when used in combination with the physical stabilizer.

Smectite clays include montmorillonite (bentonite), hectorite, saponite, and the like. Materials of this type are available under trade names such as Thixogel (Registered Trade Mark) No. 1 and Gelwhite (Registered Trade Mark) GP, H, etc. from Georgia Kaolin Company (both being montmorillonites). Attapulgite clays include the materials commercially available under the trade name Attagel (Registered Trade Mark), i.e. Attagel 40, Attagel 50 and Attagel 150 from Engelhard Minerals and Chemicals Corporation. Mixtures ofsmectite and attapulgite types in weight ratios of 4:1 to 1:5 are also useful herein. Thickening or suspending agents of the foregoing types are well known in the art, being described, for example, in U.S. Pat. No. 3,985,668 referred to above. Abrasives or polishing agents should be avoided.

The amount of water contained in these compositions should of course be neither so high as to produce unduly low viscosity and fluidity, nor so low as to produce unduly high viscosity and low flowability, thixotropic properties in either case being diminished or destroyed. Such amount is readily determined by routine experimentation in any particular instance, generally ranging from about 45 to 75 wt %, preferably about 55 to 65 wt %. The water should also be preferably deionized or softened.

So far, the description of the ADD product, except as otherwise noted, comforms to the compositions as disclosed in the aforementioned UK Patent Applications GB 2,116,199A and GB 2,140,450A.

The ADD products of these prior disclosures exhibit improved rheological properties as evaluated by testing product viscosity as a function of shear rate. The compositions exhibited higher viscosity at a low shear rate and lower viscosity at a high shear rate, the data indicating efficient fluidization and gellation well within the shear rates extant within the dishwasher machine. In practical terms, this meant improved pouring and processing characteristics as well as less leaking in the machine dispenser-cup, compared to prior liquid or gel ADD products. For applied shear rates corresponding to 3 to 30 rpm, viscosities (Brookfield) correspondingly ranged from about 15,000 to 30,000 cps to about 3000–5000 cps, as measured at room temperature by means of a LVT Brookfield viscometer after 3 minutes using a No. 4 spindle. A shear rate of 7.4 $sec^{-1}$ corresponds to a spindle rpm of about 3. An approximate ten-fold increase in shear rate produces a six- to seven-fold reduction in viscosity. With prior ADD gels, the corresponding reduction in viscosity was only about two-fold. Moreover, with such compositions, the initial viscosity taken at about 3 rpm was only about 2500–2700 cps. The compositions of the assignee's prior invention thus exhibit threshold fluidizations at lower shear rates and of significantly greater extent in terms of incremental increases in shear rate versus incremental decrease in viscosity. This property of the ADD products of the prior invention is summarized in terms of a thixotropic index (TI) which is the ratio of the apparent viscosity at 3 rpm and at 30 rpm. The prior compositions have a TI of from 2.5 to 10. The ADD compositions tested exhibited substantial and quick return to prior quiescent state consistency when the shear force was discontinued.

The present invention is based upon the discovery that the physical stability, i.e. resistance to phase separation, settling, etc., of these prior liquid aqueous ADD compositions can be significantly improved, without adversely affecting, and in some cases, advantageously affecting, their rheological properties, by adding to the composition a small but effective amount of a polyvalent metal salt of a long chain fatty acid.

As an example of the improvement in rheological propeties it has been found that the viscosties at low shear rates, e.g. at a spindle rpm of about 3, apparent viscosities may often be increased from two- to threefold with the incorporation of as little as 0.2% or less of the fatty acid metal salt stabilizer. At the same time, the physical stability may be improved to such an extent that even after six weeks or longer, over temperature ranges extending from near freezing to 40° C. and more, the compositions containing the metal salt stabilizers do not undergo any visible phase separation.

The preferred long chain fatty acids are the higher aliphatic fatty acids having from about 8 to about 22 carbon atoms, more preferably from about 10 to 20 carbon atoms, and especially preferably from about 12 to 18 carbon atoms, inclusive of the carbon atom of the carboxyl group of the fatty acid. The aliphatic radical may be saturated or unsaturated and may be straight or branched. Mixtures of fatty acids may be used, such as those derived from natural sources, such as tallow fatty acid, coco fatty acid, soya fatty acid, etc.

Thus, examples of the fatty acids from which the polyvalent metal salt stabilizers can be formed include, for example, decanoic acid, dodecanoic acid, palmitic acid, myristic acid, stearic acid, oleic acid, eicosanoic acid, tallow fatty acid, coco fatty acid, soya fatty acid, mixtures of these acids, etc. Stearic acid, in view of both commercial availability and results, is preferred.

The preferred polyvalent metals are aluminum and zinc, although other polyvalent metals, especially those of Groups IIA, IIIA, IVA, VA, VA, VIIA, IIB, IIIB, IVB, VB and VIII of the Periodic Table of the Elements can also be used. Specific examples of such other polyvalent metals include Mg, Co, Ti, Zr, V, Nb, Mn, Fe, Co, Ni, Cd, Sn, Sb, Bi, etc. Preferably, the metal salts are used in their higher oxidation states.

Many of these metal salts are commercially available. For example, the aluminum salts are available in the triacid form, e.g. aluminum stearate as aluminum tristearate, $Al(C_{17}H_{35}COO)_3$. The monoacid salts, e.g. aluminum monostearate, $Al(OH)_2(C_{17}H_{35}COO)$ and diacid salts, e.g. aluminum distearate, $Al(OH)(C_{17}H_{35}COO)_2$, and mixtures of two or three of the mono-, di- and tri-acid salts can be used for those metals, e.g. Al, with valences of +3, and mixtures of the mono- and di-acid salts can be used for those metals, e.g. Zn, with valences of +2. It is most preferred that the diacids of the +2 valent metals and the triacids of the +3 valent metals, and the tetraacids of the +4 valent metals, be used in predominant amounts. For example, at least 30%, preferably at least 50%, especially preferably from 80 to 100% of the total metal salt be in the highest possible oxidation state, i.e. each of the possible valence sites is occupied by a fatty acid residue.

The metal salts, as mentioned above, are generally commerically available but can be easily produced by, for example, saponification of a fatty acid, e.g. animal fat, stearic acid, etc., or the corresponding fatty acid ester, followed by treatment with an hydroxide or oxide of the polyvalent metal, for example, in the case of the aluminum salt, with alum, alumina, etc.

Aluminum stearate, i.e. aluminum tristearate, and zinc stearate, i.e. zinc distearate, are the preferred polyvalent fatty acid salt stabilizers.

The amount of the fatty acid salt stabilizers to achieve the desired enhancement of physical stability will depend on such factors as the nature of the fatty acid salt, the nature and amount of the thixotropic agent, detergent active compound, inorganic salts, especially TPP, other ADD ingredients, as well as the anticipated storage and shipping conditions.

Generally, however, amounts of the polyvalent metal fatty acid salt stabilizing agents in the range of from about 0.02 to 1%, preferably from about 0.06 to 0.8%, especially preferably from about 0.08 to 0.4%, provide the long term stability and absence of phase separation upon standing or during transport at both low and elevated temperatures as are required for a commercially acceptable product.

According to one preferred method of making these compositions, one should dissolve or disperse first all the inorganic salts, i.e. carbonate (when employed), silicate and tripolyphosphate, in the aqueous medium. Thickening agent is added last. The foam depressor (when employed) is preliminarily provided as an aqueous dispersion, as is the thickening agent. The foam depressant dispersion, caustic soda (when employed) and inorganic salts are first mixed at elevated temperatures in aqueous solution (deionized water) and thereafter cooled, using agitation throughout. Bleach, surfactant, fatty acid salt, stabilizer and thickener dispersion at room temperature are thereafter added to the cooled (25°-35° C.) solution. Excluding the chlorine bleach compound, total salt concentration (NaTPP, sodium silicate and carbonate) is generally about 20 to 50 wt %, preferably about 30 to 40 wt % in the composition.

Other conventional ingredients may be included in these compositions in small amounts generally less than about 3 wt % such as perfume, hydrotropic agents such as the sodium benzene, toluene, xylene and cumene sulphonates, preservatives, dyestuffs and pigments and the like, all of course being stable to chlorine bleach compound and high alkalinity (properties of all the components). Especially preferred for colouring are the chlorinated phthalocyanines and polysulphides of aluminosilicate which provide, respectively, pleasing green and blue tints, $TiO_2$ may be employed for whitening or neutralizing off-shades.

The liquid ADD compositions of this invention are readily employed in known manner for washing dishes, other kitchen utensils and the like in an automatic dish washer, provided with a suitable detergent dispenser, in an aqueous wash bath containing an effective amount of the composition.

The invention may be put into practice in various ways and a number of specific embodiments will be described to illustrate the invention with reference to the accompanying examples.

All amounts and proportions referred to herein are by weight of the composition unless otherwise indicated.

EXAMPLE 1

In order to demonstrate the effect of the metal salt stabilizer liquid ADD formulations are prepared with varying amounts of stabilizer and thixotropic thickener. Initially the following ingredients are mixed in a Guisti mixer at 50°-60° C.:

| | % |
|---|---|
| Deionized water | 41.10 + y − x |
| Caustic soda solution (50% NaOH) | 1.00 |
| Sodium carbonate, anhydrous | 5.00 |
| Sodium silicate, 47.5% solution of $Na_2O:SiO_2$ ratio of 1:2.4 | 15.74 |
| Sodium TPP (substantially anhydrous-i.e. 0–5%, especially 3%, moisture) (Thermphos NW) | 12.00 |
| Sodium TPP (hexahydrate) (Thermphos N hexa) | 12.00 |

The mixture is cooled at 25°-30° C. and agitation maintained throughout, and the following ingredients at room temperature are added thereto;

| | |
|---|---|
| Sodium hypochlorite solution (11% available chlorine) | 9.00 |
| Monostearylphosphate | 0.16 |
| DOWFAX 3B-2 (45% Na monodecyl/didecyl diphenyl oxide disulphonate-aqueous solution) | 0.80 |
| Al tristearate or Zn distreate | x |
| Gel White H | 2.00 − y |

The monostearyl phosphate foam depressant and Dowfax 3B2 detergent active compound are added to the mixture just before the aluminum tristearate or zinc distearate stabilizer or right before the Gel White H thickener.

Each of the resulting liquid ADD formulations as shown in Table I are measured for density, CDR (Capillary Drainage Rate), apparent viscosity at 3 and 30 rpm, and physical stability (phase separation) on standing and in a shipping test. The results are also shown in Table I.

From the data reported in Table I the following conclusions are reached:

The incorporation of 0.2% Al stearate in a 1.5% or in a 1% Gel White H containing formula as well as the incorporation of 0.1% Al stearate or of 0.1% Zinc stearate in a 2% Gel White H containing formula leads to a simultaneous increase of the physical stability and of the apparent viscosity (Table I, runs 1 (control), 2, 3, 6, and 9.

The incorporation of 0.1% Al stearate in a 1% Gel White H containing formula, of 0.2% Al stearate in a 0.5% Gel White H containing formula, and of 0.3 or 0.4% Al stearate in a 0.25% Gel White H containing formula leads to an increase of the physical stability without any drastic viscosity increase (Table II, runs 1 (control), 4, 7, 10 and 11).

For the combination of 0.1% Al stearate and 0.5% Gel White H (Run 8) the apparent viscosity values remain acceptable but no significant improvement in physical stability is obtained.

TABLE I

| RUN | FORMULATION | DENSITY (g/cm³) | CDR (min) (1) | BROOK. LVT VISCOSITY (KCPS) (2) 3 RPM | 30 RPM | UNSHAKEN LIQUID SEPARATION (%) (AFTER 12 WEEKS) 4° C. IN GLASS (3) | RT IN GLASS (3) | 35° C. IN GLASS (3) | 43° C. IN GLASS (3) | RT IN PLASTIC (4) | SHIPPING TEST (%) (6) |
|---|---|---|---|---|---|---|---|---|---|---|---|
| 1 (Control) | $H_2O$ = 41.1%<br>Stabilizer = 0<br>(X = 0)<br>Gel White H = 2.0%<br>(Y = 0) | 1.28 +/− 0.92 | 9 +/− 2 | 15 +/− 5 | 4 +/− 1 | 2–8 | 0–8 | 0.4 | 0 | 6–16 | 9–12 |
| 2 | $H_2O$ = 41.4%<br>Al Stearate = 0.2%<br>(X = 0.2)<br>Gel White H = 1.5%<br>(Y = 0.5) | 1.29 | 6'50" | 43 | 5.9 | No separation after 6 weeks in a glass bottle left on a shelf (5) | | | | | 0 |
| 3 | $H_2O$ = 41.9%<br>Al Stearate = 0.2%<br>(X = 0.2)<br>Gel White H = 1%<br>(Y = 1.0) | 1.30 | 6'50" | 26 | 6.1 | No separation after 6 weeks in a glass bottle left on a shelf (5) | | | | | 0 |
| 4 | $H_2O$ = 42.4%<br>Al Stearate = 0.2%<br>(X = 0.2)<br>Gel White H = 0.5%<br>(Y = 1.5) | 1.33 | 4'10" | 11 | 3.8 | No separation after 6 weeks in a glass bottle left on a shelf (5) | | | | | 0 |
| 5 | $H_2O$ = 42.65%<br>Al Stearate = 0.2%<br>(X = 0.2)<br>Gel White H = 0.25%<br>(Y = 1.75) | 1.35 | 4'50" | 4 | 1.7 | No separation after 6 weeks in a glass bottle left on a shelf (5) | | | | | 13 |
| 6 | $H_2O$ = 41.0%<br>Al Stearate = 0.1%<br>Gel White H = 2% | 1.26 | 8'33" | 36 | 9 | 0 | 0 | 0 | 0 | 2 | — |
| 7 | $H_2O$ = 42.0%<br>Al Stearate = 0.1%<br>Gel White H = 1% | 1.30 +/− 0.01 | 6'30" +/− 30" | 17 +/− 4 | 5 +/− 2 | 0 | 0 | 0 | 0 | 0–5 | — |
| 8 | $H_2O$ = 42.5%<br>Al Stearate = 0.1%<br>Gel White H = 0.5% | 1.31 | 4'50" | 10 | 3.5 | 8 | 4 | <2 | <2 | 9 | — |
| 9 | $H_2O$ = 41.0%<br>Zn distearate = 0.1%<br>Gel White H = 2% | 1.25 | 5'09" | 40 | 4.6 | 0 | 0 | 0 | 0 | 0 | — |
| 10 | $H_2O$ = 42.55%<br>Al Stearate = 0.3%<br>Gle White H = 0.25% | 1.35 | 4'25" | 6 | 2.6 | No separation after 6 weeks in a glass bottle left on a shelf (5) | | | | | 0 |
| 11 | $H_2O$ = 42.45%<br>Al Stearate = 0.4%<br>Gel White H = 0.25% | 1.35 | 4'25" | 10 | 2.9 | No separation after 6 weeks in a glass bottle left on a shelf (5) | | | | | 0 |

Notes to Table I (1) No. 1 filter paper (Whatman) having a 6.4 cm circle traced thereon is laid on a flat glass plate, 10 cm × 10 cm. A plastic tube, 6.4 cm long, 3.4 cm diameter, is placed in a standing position, centered on the circle. The tube is filled with the sample liquid ADD composition (after standing for one day). The time needed for the solvent to seep out of the tube and reach the traced circle is measured. Time is measured on three sides of the circle and averaged. Faster times means that the gel is not successfully retaining the solvent (water) which can then leak into the filter paper. Times greater than 5 minutes are considered good. Times between 4 and 5 minutes are considered unstable but acceptable.

(2) Measured with spindle 4 after 3 minutes on 24 hour old samples.

(3) In height.

(4) In weight.

(5) At 4° C., room temperature (RT = 20±2° C.), 35° C. and 43° C. in glass bottle.

(6) Liquid separation measured after 6 weeks and 3000 Kms in a private car (in weight in a plastic bottle).

EXAMPLE 2

Using the same composition and preparation method as in Example 1 except that in place of Gel White H as the thixotropic thickener, 2% of Attagel 50 (an attapulgite clay) or 0.4% of Bentone EW (a specially processed Hectorite clay) was used with (runs 2 and 4) or without (control runs 1 and 3) aluminum tristearate. The apparent viscosities and physical stabilities were measured in the same manner as described for Example 1. The results are shown in Table II.

From the results shown in Table II it can be seen that small amounts of aluminum stearate are equally effective in increasing the physical stability of attapulgite clay and hectorite clay based liquid thixotropic automatic dishwasher detergent compositions.

TABLE II

| RUN | FORMULATION | Density (g/cm³) | CDR (min) | Brook LVT Viscosity (KCPS) (1) 3 RPM | 30 RPM | Unshaken Liquid Separation % (after 12 weeks) 4° C. IN GLASS (2) | RT IN GLASS (2) | 35° C. IN GLASS (2) | 43° IN GLASS (2) | RT IN PLASTIC (2) |
|---|---|---|---|---|---|---|---|---|---|---|
| 1 (Control) | H2O = 42.7% Bentone EW = 0.4% instead of Gel White H | 1.30 | — | liq. sep. after 1 day | | 25 | 32 | 32 | 17 | — |
| 2 | As above but with 0.1% Al trisearate just before Bentone H2O = 42.6% | 1.33 | — | 5 | 2.1 | 4 | 5 | 6 | 8 | — |
| 3 (Control) | H2O = 41.1% Attagel 50 = 2% instead of Gel White H | 1.33 | — | 4 | 1.3 | 12 | 17 | 14 | 24 | — |
| 4 | As above but with 0.1% Al tristearate just before Attagel H2O = 41.0% | 1.36 | — | 6 | 1.7 | 3 | 0 | 0 | 0 | — |

(1) Measured with Spindle 4 after 3 min. (24 hours after making);
(2) In height;
(3) In weight.

EXAMPLE 3

This example shows that inorganic aluminum and zinc salts, including $Al_2O_3$, $ZnSO_4$ and $Al_2(SO_4)_3$ and the monovalent metal fatty acid salts do not provide improved physical stability to the liquid thixotropic ADD compositions. Using the same formulation as in Run 6 of Example 1 0.1% of each of $Al_2O_3$, $ZnSO_4$, $Al_2(SO_4)_3$ and sodium stearate was used in place of 0.1% aluminum stearate. The results of the measurements of apparent viscosity and physical stability are shown in Table III.

EXAMPLE 4

The following gel-like thixotropic liquid ADD is prepared following the same general procedures as in Example 1:

| Ingredient | Amount (A.I.) wt % |
|---|---|
| Sodium silicate (47.5% sol'n $Na_2O = S_1 O_2 = 1 = 2.4$) | 7.48 |
| Monostearyl phosphate | 0.16 |
| Dowfax 3B-2 | 0.37 |
| Thermphos NW | 12.0 |
| Thermphos N hexa | 12.0 |
| Aluminum tristearate | 0.1 |
| Sodium Carbonate, anhydrous | 4.9 |
| Caustic soda solution (38% NaOH) | 3.0 |

TABLE III

| RUN | FORMULATION | DENSITY (g/cm³) | CDR (min) (1) | BROOK. LVT VISCOSITY (KCPS) (2) 3 RPM | 30 RPM | UNSHAKEN LIQUID SEPARATION (%) (AFTER 12 WEEKS) 4° C. IN GLASS (3) | RT IN GLASS (3) | 35° C. IN GLASS (3) | 43° C. IN GLASS (3) | RT IN PLAS-TIC (4) | SHIP-PING TEST (%) (6) |
|---|---|---|---|---|---|---|---|---|---|---|---|
| 1 Control | $H_2O$ = 41.1% Stabilizer = 0 (X = 0) Gel White H = 2.0% | 1.28 +/− 0.02 | 9 +/− 2 | 15 +/− 5 | 4 +/− 1 | 2–8 | 0–8 | 0–4 | 0 | 6–16 | 9–12 |
| 2 | $H_2O$ = 41.0% Al2(SO4)3 = 0.1% instead of Al Stearate Gel White H = 2.0% | 1.30 | — | 10 | 4 | Srong decantation after 4 weeks | | | | | — |
| 3 | $H_2O$ = 41.0% ZnSO4 = 0.1% instead of Al Stearate Gel White H = 2.0% | 1.32 | — | 8 | 2.9 | Strong decantation after 4 weeks | | | | | — |
| 4 | $H_2O$ = 41.0% Al2O3 = 0.1% instead of Al Stearate Gel White H = 2.0% | 1.29 | 10'29" | 15 | 4.1 | Strong decantation after 4 weeks | | | | | — |
| 5 | $H_2O$ = 41.0% addition of 0.1% Al2O3 in the first part of caustic soda Gel White H = 2.0% | 1.27 | 12'19" | 22 | 6.2 | Strong decantation after 6 weeks | | | | | — |
| 6 | $H_2O$ = 41.0% Stearic acid Na salt = 0.1% instead of Al Stearate | 1.30 | 7'35" | 26 | 4.8 | 4 | 4 | 0 | 0 | 8 | — |

Notes: (1)–(4) and (6) same as in Table I

-continued

| Ingredient | Amount (A.I.) wt % |
|---|---|
| Pharmagel Ex Uroclay (Mg/Al Silicate clay) | 1.25 |
| Sodium hypochlorite solution (11%) | 1.0 |
| Water | balance |
| pH = 12.5 to 12.9 | |

Minor amounts of perfume, color, etc. can also be added to formulation.

What is claimed is:

1. An aqueous thixotrophic automatic dishwasher composition comprising approximately by weight:

(a) 5 to 35% alkali metal tripolyphosphate;

(b) 2.5 to 20% sodium silicate;

(c) 0 to 9% alkali metal carbonate;

(d) 0.5 to 2% chlorine bleach stable, water-dispersible organic detergent active material;

(e) 0.1 to 0.5% chlorine bleach stable foam depressant;

(f) chlorine bleach compound in an amount to provide about 0.2 to 4% of available chlorine;

(g) 0.1 to 10.0% thixotropic thickener in an amount sufficient to provide the composition with a thixotropy index of about 2 to 10;

(h) sodium hydroxide in amount sufficient to provide the composition with a pH of at least about 9.5;

(i) 0.02 to 0.4% of a polyvalent metal salt of a long chain 8 to 22 carbon fatty acid as a physical stability of the composition; and (j) water in an amount so as not to destroy the thixotropic properties of the composition.

2. The composition of claim 1 wherein the physical stabilizer is selected from the group consisting of stearates and metal salts thereof.

3. The composition of claim 2 wherein the physical stabilizer (i) is aluminum tristearate or zinc distearate.

4. The composition of claim 1, wherein the physical stabilizer (i) is a metal salt of an aliphatic fatty acid having from about 10 to 20 carbon atoms and the metal is selected from the group consisting of Mg, Ca, Al and Zn.

5. The composition of claim 1, wherein the physical stabilizer (i) is a metal salt of an aliphatic fatty acid having from about 12 to 18 carbon atoms.

6. The composition of claim 1, wherein the physical stabilizer (i) is a polyvalent metal salt of an aliphatic fatty acid selected from the group consisting of stearic acid, myristic acid, palmitic acid, oleic acid, tallow fatty acid, soya fatty acid, and mixtures thereof.

7. The composition of claim 1 wherein the sodium hydroxide (h) is present in an amount from about 0.5% to 6%.

8. The composition of claim 1 wherein the thixotropic thickener (g) is an inorganic, colloid-forming clay.

9. The composition of claim 6 wherein the clay is an attapulgite or a smectite clay.

10. The composition of claim 6 wherein the clay thickener is in the range of from about 0.1 to 3%.

11. The composition of claim 1 containing from about 0.1 to 2% by weight of an inorganic colloid-forming clay as the thixotropic thickener (g).

12. The composition of claim 1 having a pH of about 10.5 to about 13.5.

13. The composition of claim 1, wherein at applied shear rates of 3 to 30 rpm, the viscosities (Brookfield) correspondingly range from about 10,000 to 30,000 cps to about 3000 to 7000 cps.

14. The composition of claim 1 adapted to have a density of about 1.29 g/cm$^3$.

15. The composition of claim 1, in which the foam depressant (e) is an alkyl acid phosphate ester or an alkyl phosphonic acid ester containing one or two $C_{12-20}$ alkyl groups or a mixture thereof and the detergent active material (d) is selected from the group consisting of branched alkali metal mono- and di- $C_{8-14}$ alkyl diphenyl oxide mono- and disulfonates and linear alkali metal mono- and di - $C_{8-14}$ alkyl diphenyl oxide mono- and disulfonates.

16. The composition of claim 1, wherein the alkali metal carbonate (c) is present in an amount from about 2% to about 9%.

* * * * *